US008139023B2

(12) United States Patent
Zhen

(10) Patent No.: US 8,139,023 B2
(45) Date of Patent: Mar. 20, 2012

(54) BRIGHTNESS ADJUSTABLE ELECTRICAL APPARATUS

(75) Inventor: Yong-Jie Zhen, Suzhou (CN)

(73) Assignees: AU Optronics (Suzhou) Corp., Suzhou Industrial Park (CN); AU Optronics Corp., Hsin-Chu (TW)

( * ) Notice: Subject to any disclaimer, the term of this patent is extended or adjusted under 35 U.S.C. 154(b) by 599 days.

(21) Appl. No.: 12/367,818

(22) Filed: Feb. 9, 2009

(65) Prior Publication Data

US 2010/0117946 A1 May 13, 2010

(30) Foreign Application Priority Data

Nov. 10, 2008 (CN) ..... 2008 1 0202474

(51) Int. Cl.
*G89G 3/36* (2006.01)
*G09G 3/30* (2006.01)

(52) U.S. Cl. ..... 345/102; 345/82

(58) Field of Classification Search ..... 345/82, 345/39, 83, 108, 81, 76, 690, 12, 207, 102, 345/173, 175, 104, 649
See application file for complete search history.

(56) References Cited

U.S. PATENT DOCUMENTS

| | | | | |
|---|---|---|---|---|
| 5,952,992 | A | 9/1999 | Helms | |
| 6,426,736 | B1 * | 7/2002 | Ishihara | 345/102 |
| 6,713,705 | B1 | 3/2004 | Satou et al. | |
| 7,095,392 | B2 | 8/2006 | Lin | |
| 7,348,946 | B2 * | 3/2008 | Booth et al. | 345/82 |
| 7,714,265 | B2 * | 5/2010 | Fadell et al. | 250/214 AL |
| 7,750,282 | B2 * | 7/2010 | Mahowald et al. | 250/214 AL |
| 2003/0122749 | A1 | 7/2003 | Booth et al. | |
| 2006/0262530 | A1 | 11/2006 | Sakai et al. | |
| 2008/0106492 | A1 * | 5/2008 | Chen | 345/39 |

FOREIGN PATENT DOCUMENTS

| | | | |
|---|---|---|---|
| CN | 1432906 | A | 7/2003 |
| CN | 1608281 | A | 4/2005 |
| CN | 1869787 | A | 11/2006 |

* cited by examiner

*Primary Examiner* — Nabil Hindi
(74) *Attorney, Agent, or Firm* — Kirton McConkie; Evan R. Witt

(57) ABSTRACT

A brightness adjustable electrical apparatus is disclosed. The electrical apparatus comprises a lighting module, a control unit and at least one light emitting diode (LED). The control unit is electrically connected to the lighting module for lighting control. The LED is electrically connected to the control unit, wherein the LED has an indicating mode to indicate the working state of the electrical apparatus and a detecting mode to detect the surrounding light intensity.

17 Claims, 2 Drawing Sheets

BRIGHTNESS ADJUSTABLE ELECTRICAL APPARATUS

FIELD OF THE INVENTION

The present invention relates to an electrical apparatus, and more particularly, to a brightness adjustable electrical apparatus.

BACKGROUND OF THE INVENTION

Currently, electrical devices with a lighting module have been widely used by people. Taking liquid crystal displays (LCDs) for example, with their advantages of high image quality, compact size, light weight, low driving voltage, low power consumption and various applications, LCDs have been introduced into various electrical products, such as portable computers, mobile phones, personal digital assistants and color televisions.

Normally, an LCD includes a liquid crystal display panel and a backlight module. The backlight module is configured to provide a light source to the liquid crystal display panel for displaying image. It is understood that a conventional LCD may include a photo-sensor for detecting the surrounding light intensity and for adjusting the brightness of the backlight module according to the detecting result of the photo-sensor, thereby saving energy.

However, the electrical device which can detect the surrounding light intensity, such as an LCD, needs an additional photo-sensor, and thus the cost thereof is increased. Furthermore, if the photo-sensor is disposed on the exterior of the electrical device, thereby the electrical device needs a case with an opening for accommodating it; therefore, the design appearance of the electrical device needs to be changed, and the cost thereof is also increased.

SUMMARY OF THE INVENTION

Therefore, an aspect of the present invention is to provide a brightness adjustable electrical apparatus which uses at least one light emitting diode (LED) to indicate the working state thereof and detect the surrounding light intensity, thereby omitting an additional photo-sensor and reducing cost thereof.

According to one embodiment of the present invention, the brightness adjustable electrical apparatus comprises a lighting module, a control unit and at least one LED. The control unit is electrically connected to the lighting module to control the brightness thereof. The LED is electrically connected to the control unit, wherein the LED has an indicating mode and a detecting mode, and wherein the LED is configured to indicate the working state of the electrical apparatus when the LED is in the indicating mode, and wherein the LED is configured to detect the surrounding light intensity and transmit a detecting signal to the control unit when the LED is in the detecting mode, and the control unit adjusts the brightness of the lighting module according to the detecting signal.

According to another embodiment of the present invention, the brightness adjustable electrical apparatus comprises a display module, a control unit and at least one LED. The control unit is electrically connected to the display module to control the display brightness thereof. The LED is electrically connected to the control unit, wherein the LED has an indicating mode and a detecting mode, and wherein when the LED is in the indicating mode, the LED is configured to indicate the working state of the electrical apparatus, and wherein when the LED is in the detecting mode, the LED is configured to detect the surrounding light intensity and transmit a detecting signal to the control unit, and the control unit adjusts the display brightness of the display module according to the detecting signal.

According to another embodiment of the present invention, the above-mentioned electrical apparatus is a display apparatus, and the display module is a display panel.

Therefore, with the use of the brightness adjustable electrical apparatus disclosed in the embodiments of the present invention, the LED is disposed at the exterior thereof to indicate the working state thereof and detect the surrounding light intensity, thereby omitting an additional photo-sensor to reduce the cost.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

In order to make the illustration of the present invention more explicit and complete, the following description is stated with reference to FIG. 1 through FIG. 5.

Figure 1:
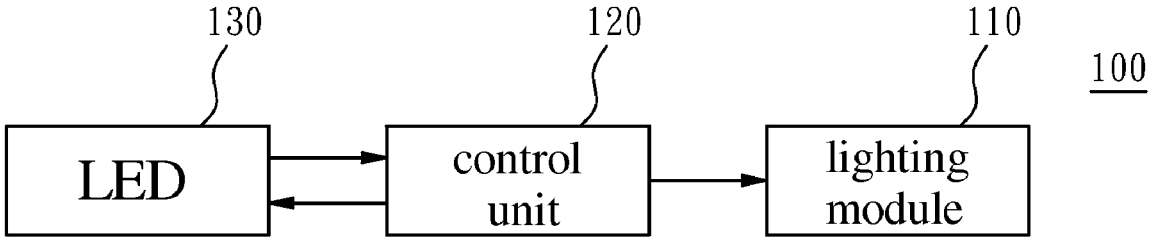
FIG. 1 is a block diagram showing a brightness adjustable electrical apparatus according to one embodiment of the present invention.

Referring to FIG. 1, a block diagram showing a brightness adjustable electrical apparatus according to one embodiment of the present invention is presented herein. The brightness adjustable electrical apparatus of the present embodiment can automatically adjust the brightness of itself according to the surrounding light intensity, thereby saving energy or achieving optimum lighting and displaying effectiveness. The electrical apparatus 100 comprises a lighting module 110, a control unit 120 and at least one LED 130. The lighting module 110 is electrically connected to the control unit 120 for lighting. The control unit 120 is electrically connected to the lighting module 110 and the LED 130, respectively. The LED 130 is disposed at the exterior of the electrical apparatus 100 for indicating the working state thereof and detecting the surrounding light intensity.

Figure 2:
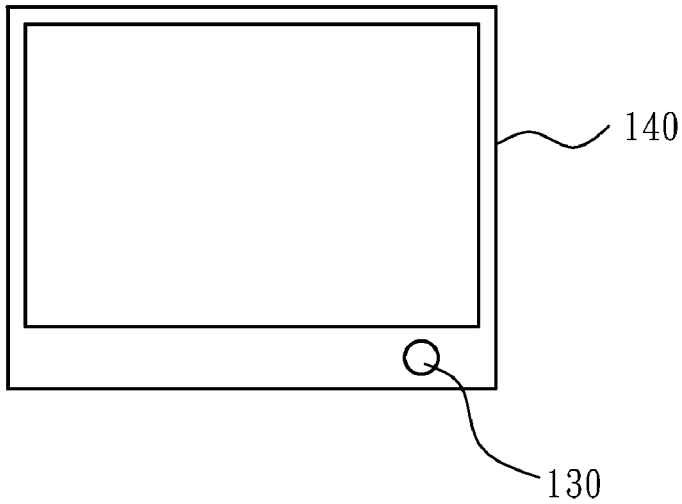
FIG. 2 is a front view showing the brightness adjustable electrical apparatus according to one embodiment of the present invention.

Referring to FIG. 1 and FIG. 2, FIG. 2 is a front view showing the brightness adjustable electrical apparatus according to one embodiment of the present invention. In the present embodiment, the electrical apparatus 100 may be an LCD apparatus or an electrical apparatus comprising the LCD apparatus, such as desk-top computers, portable computers, mobile phones, portable apparatus, personal digital assistants, LCD televisions, mobile displays, digital camera or other electrical apparatus. At this time, the electrical apparatus 100 may further comprise an LCD panel 140, and the backlight module disposed opposite to the LCD panel for providing a light source to the LCD panel 140. The lighting module 110 is one of the backlight module components. Generally, the backlight module may be an edge lighting backlight module or a bottom lighting backlight module. Referring to FIG. 2, the LED 130 may be disposed at one side of the LCD panel 140. The lighting module 110 may include at least one light source (not shown), such as cold cathode fluorescent lamps (CCFL), hot cathode fluorescent lamps (HCFL), LEDs, organic light emitting diodes (OLED), flat fluorescent lamps (FFL) or electro-luminescence (EL).

Figure 3:
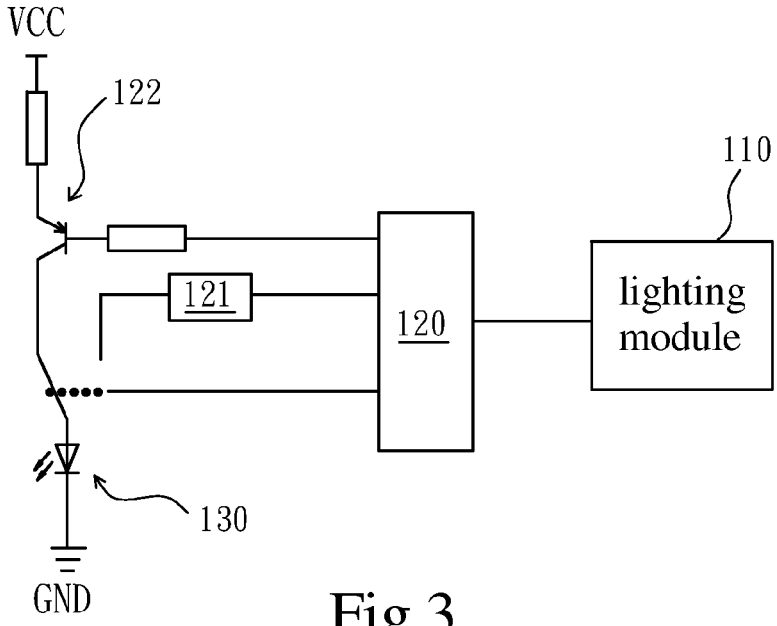
FIG. 3 is an equivalent circuit diagram showing the brightness adjustable electrical apparatus according to one embodiment of the present invention.

Referring to FIG. 3, an equivalent circuit diagram showing the brightness adjustable electrical apparatus according to one embodiment of the present invention is presented herein. The control unit 120 of the present embodiment may be a micro-control unit (MCU) for controlling the lighting module 110 and the LED 130. The control unit 120 includes an analog-to-digital converter 121 and a switch device 122. The analog-to-digital converter 121 is electrically connected to the LED 130 configured to convert an analog detecting signal thereof according to the surrounding light intensity of a digital detecting signal, and to transmit the digital detecting signal to the control unit 120. The switch device 122 may be a transistor electrically connected to a power source VCC and the LED 130 for opening/closing the electrical route therebetween. The power source VCC is configured to provide power (such as current) to the LED 130, thereby allowing the LED 130 to emit light.

Referring to FIG. 1 and FIG. 3 again, the LED 130 of the present embodiment may be an inorganic LED or an organic LED and have an indicating mode and a detecting mode, wherein the LED 130 is switched into the indicating mode or the detecting mode by the control unit 120. When the LED 130 is in the indicating mode, the control unit 120 controls the LED 130 to emit light for indicating the working states of the electrical apparatus 100, such as on/off state, energy saving state, normal/abnormal state, alarm state or other working state. In an alternative embodiment of the present invention, the electrical apparatus 100 may include a plurality LEDs 130 with varied color light for indicating varied working states, and at least one of the LEDs 130 has the indicating mode and the detecting mode. When the LED 130 is in the detecting mode, the control unit 120 controls the switch device 122 to close the electrical route between the power source VCC and the LED 130. Thus, this will result in the LED 130 detecting the surrounding light intensity. It is generally understood that a normal LED can have a light emitting function and a light detecting function. Therefore, the LED 130 which is disposed on the electrical apparatus 100 can be configured to detect the surrounding light intensity. When the LED 130 detects photo-energy (surrounding light intensity) from the exterior, the LED 130 can transmit an analog detecting signal to the control unit 120. At this time, the analog-to-digital converter 121 can convert the analog detecting signal to a digital detecting signal, and transmit the digital detecting signal to the control unit 120. Therefore, the control unit 120 can determine to adjust the brightness of the lighting module 110 or not according to the detecting signal from the LED 130.

Referring to FIG. 1 again, when the surrounding light intensity varies beyond a predetermined tolerated range, the control unit 120 can transmit a control signal to the lighting module 110 according to the detecting signal from the LED 130 for adjusting the brightness thereof. In the present embodiment, the electrical apparatus 100 may be the LCD apparatus or the electrical apparatus comprising the LCD apparatus, when the LED 130 detects that the surrounding light intensity is increasing, the control unit 120 can control the lighting module 110 to increase the brightness thereof, thereby enhancing the contrast of the LCD. On the contrary, when the LED 130 detects that the surrounding light intensity is reducing, the control unit 120 can control the lighting module 110 to reduce the brightness thereof, thereby enhancing the contrast thereof and saving energy.

It notes that the indicating mode and the detecting mode of the LED 130 can be performed alternately with a predetermined interval there between. At this time, the detecting mode of the LED 130 can have a short time period. For example, the time period of the indicating mode may be from 3 minutes to 7 minutes, and the time period of the detecting mode may be from 10 micro seconds to 30 micro seconds, especially the best time period of the indicating mode is 5 minutes and the best time period of the detecting mode is 20 micro second. However, the time periods of the indicating mode and the detecting mode are not limited to this, and can be adjusted according to actual necesities. When one time period of the detecting mode is accomplished, the control unit 120 can switch the state of the LED 130 from the detecting mode to the indicating mode immediately. Since the time period of the detecting mode is very short, it is not easy to notice the detecting mode by users. Therefore, the working state showing function of the LED 130 can be enhanced.

Therefore, the electrical apparatus 100 of the present embodiment includes the LED 130 disposed at the exterior thereof for indicating the working state thereof and detecting the surrounding light intensity, thereby saving energy and omitting an additional photo-sensor to reduce the cost. Furthermore, the appearance design of the electrical apparatus 100 needs not to be changed for disposing the additional photo-sensor.

Figure 4:
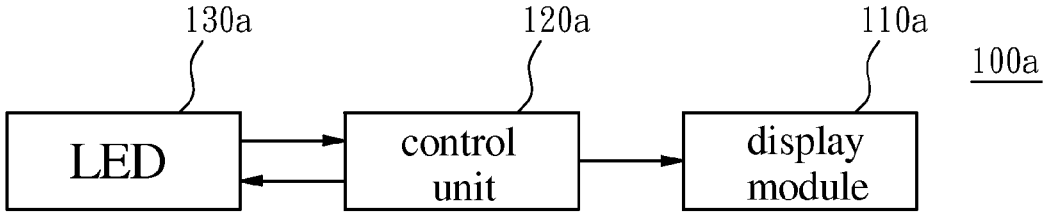
FIG. 4 is a block diagram showing a brightness adjustable electrical apparatus according to another embodiment of the present invention.

Referring to FIG. 4, a block diagram showing a brightness adjustable electrical apparatus according to another embodiment of the present invention is presented herein. In another present invention embodiment, the electrical apparatus 100*a* may be other display apparatus, such as an organic electro luminescence display (OEL), an organic light emission diode display (OLED), a light emission diode (LED) display, plasma display panel (PDP), field emission display, carbon nano-tube (CNT) display, E-ink display or an electrical apparatus including the above-mentioned displays. The electrical apparatus 100*a* comprises a display module 110*a*, a control unit 120*a* and at least one LED 130*a*. The display module 110*a* may be a display panel to display image. The control unit 120*a* is respectively electrically connected to the display module 110*a* and the LED 130*a* to control the display brightness of the display module 110*a* and switch the LED 130*a* to be in the indicating mode or the detecting mode. The LED 130*a* is disposed at the exterior of the electrical apparatus 100*a* for indicating the working state thereof and detecting the surrounding light intensity. When LED 130*a* is in the detecting mode, the control unit 120*a* can control the LED 130*a* to detect the surrounding light intensity, thereby allowing the control unit 120*a* to adjust the display brightness of the display module 110*a* according to the detecting signal from the LED 130*a*.

Figure 5:
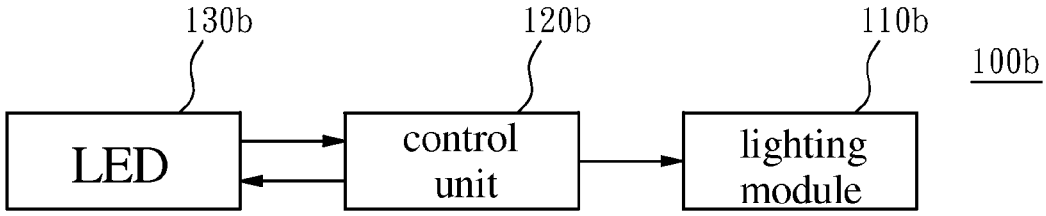
FIG. 5 is a block diagram showing a brightness adjustable electrical apparatus according to another embodiment of the present invention.

Referring to FIG. 5, a block diagram showing a brightness adjustable electrical apparatus according to another embodiment of the present invention is presented herein. In yet another present invention embodiment, the lighting module 110*b* of the electrical apparatus 100*b* can be configured to illuminate objects. At this time, the electrical apparatus 100*b* may be a camera or a video camera, and the lighting module 110*b* may be a flash lamp. When the LED 130*b* is in the indicating mode, the control unit 120*b* controls the LED 130*b* to emit light for shoeing the working state of the electrical apparatus 100*b*. When the LED 130*b* is in the detecting mode, the control unit 120*b* can control the LED 130*b* to detect the surrounding light intensity and adjust the brightness of the lighting module 110*b* according to the detecting signal from the LED 130*b*. In the present embodiment, when the LED 130*b* detects that the surrounding light intensity is reduced, the control unit 120*b* can control the lighting module 110*b* to increase the brightness thereof, thereby enhancing the brightness for taking photos. On the contrary, when the LED 130*b* detects that the surrounding light intensity is increased, the control unit 120*b* can control the lighting module 110*b* to reduce the brightness thereof, thereby saving energy.

Therefore, the brightness adjustable electrical apparatus of the present invention can use the LED to indicate the working state thereof and detect the surrounding light intensity, thereby omitting an additional photo-sensor to reduce the cost.

As is understood by a person skilled in the art, the foregoing embodiments of the present invention are strengths of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A brightness adjustable electrical apparatus, comprising:

a lighting module;

a control unit electrically connected to the lighting module for controlling the brightness thereof;

at least one light emitting diode electrically connected to the control unit, wherein the light emitting diode has an indicating mode and a detecting mode;

wherein when the light emitting diode is in the indicating mode, the light emitting diode indicates the working state of the electrical apparatus;

wherein when the light emitting diode is in the detecting mode, the light emitting diode detects the surrounding light intensity and transmit a detecting signal to the control unit, and the control unit adjusts the brightness of the lighting module according to the detecting signal, and the time period of the detecting mode is from 10 micro seconds to 30 micro seconds.

2. The electrical apparatus as claimed in claim 1, wherein the time period of the indicating mode is from 3 minutes to 7 minutes.

3. The electrical apparatus as claimed in claim 1, wherein the detecting signal is an analog signal, and the control unit includes an analog-to-digital converter to convert the detecting signal to a digital detecting signal.

4. The electrical apparatus as claimed in claim 1, wherein the control unit includes a switch device electrically connected between a power source and the light emitting diode, and when the light emitting diode is in the detecting mode, the control unit controls the switch device to close the electrical route between the power source and the light emitting diode.

5. The electrical apparatus as claimed in claim 1, wherein the control unit is a micro control unit (MCU).

6. The electrical apparatus as claimed in claim 1, wherein the electrical apparatus is a display apparatus.

7. The electrical apparatus as claimed in claim 1, wherein the electrical apparatus is a liquid crystal display apparatus, and the lighting module is a backlight module.

8. The electrical apparatus as claimed in claim 1, wherein the control unit controls the lighting module to increase the brightness thereof when the light emitting diode detects the surrounding light intensity is increased, and the control unit controls the lighting module to reduce the brightness thereof when the light emitting diode detects that the surrounding light intensity is reduced.

9. A brightness adjustable electrical apparatus, comprising:

a display module;

a control unit electrically connected to the display module to control the display brightness thereof;

at least one light emitting diode electrically connected to the control unit, wherein the light emitting diode has an indicating mode and a detecting mode;

wherein when the light emitting diode is in the indicating mode, the light emitting diode indicates the working state of the electrical apparatus;

wherein when the light emitting diode is in the detecting mode, the light emitting diode detects the surrounding light intensity and transmit a detecting signal to the control unit, and the control unit adjusts the display brightness of the display module according to the detecting signal, and the time period of the detecting mode is from 10 micro seconds to 30 micro seconds.

10. The electrical apparatus as claimed in claim 9, wherein the display module is a display panel.

11. The electrical apparatus as claimed in claim 9, wherein the time period of the indicating mode is from 3 minutes to 7 minutes.

12. The electrical apparatus as claimed in claim 9, wherein the detecting signal is an analog signal, and the control unit includes an analog-to-digital converter to convert the detecting signal to a digital detecting signal.

13. The electrical apparatus as claimed in claim 9, wherein the control unit includes a switch device electrically connected between a power source and the light emitting diode, and when the light emitting diode is in the detecting mode, the control unit controls the switch device to close the electrical route between the power source and the light emitting diode.

14. The electrical apparatus as claimed in claim 9, wherein the control unit is a micro control unit.

15. The electrical apparatus as claimed in claim 9, wherein the control unit controls the lighting module to increase the brightness thereof when the light emitting diode detects that the surrounding light intensity is increased, and the control unit controls the lighting module to reduce the brightness thereof when the light emitting diode detects that the surrounding light intensity is reduced.

16. A liquid crystal display apparatus, comprising:

a liquid crystal display panel;

a backlight module disposed opposite to the liquid crystal display panel;

a control unit electrically connected to the backlight module for controlling the brightness thereof;

at least one light emitting diode electrically connected to the control unit, wherein the light emitting diode has an indicating mode and a detecting mode;

wherein when the light emitting diode is in the indicating mode, the light emitting diode is configured to indicate the working state of the liquid crystal display apparatus;

wherein when the light emitting diode is in the detecting mode, the light emitting diode is configured to detect the surrounding light intensity and transmit a detecting signal to the control unit, and the control unit adjusts the brightness of the backlight module according to the detecting signal, and the time period of the detecting mode is from 10 micro seconds to 30 micro seconds.

17. A display apparatus, comprising:

a display panel;

a control unit electrically connected to the display panel for controlling the display brightness thereof;

at least one light emitting diode electrically connected to the control unit, wherein the light emitting diode has an indicating mode and a detecting mode;

wherein when the light emitting diode is in the indicating mode, the light emitting diode is configured to indicate the working state of the display apparatus;

wherein when the light emitting diode is in the detecting mode, the light emitting diode is configured to detect the surrounding light intensity and transmit a detecting signal to the control unit, and the control unit adjusts the brightness of the display panel according to the detecting signal, and the time period of the detecting mode is from 10 micro seconds to 30 micro seconds.

* * * * *